United States Patent [19]

Fiore et al.

[11] 4,186,920

[45] Feb. 5, 1980

[54] EXERCISER FOR LOWER LEG, ANKLE, AND FOOT MUSCLES

[76] Inventors: Russell D. Fiore, 3 Fuller Rd., Attleboro, Mass. 02703; Russell D. Fiore, 24 Princess Ave., Cranston, R.I. 02920

[21] Appl. No.: 853,450

[22] Filed: Nov. 21, 1977

[51] Int. Cl.[2] ..... A63B 23/04

[52] U.S. Cl. ..... 272/96; 128/25 B; 272/132; 403/138

[58] Field of Search ..... 272/96, 146, 132; 128/25 B; 73/379, 380, 381; 403/138, 144

[56] References Cited

U.S. PATENT DOCUMENTS

| | | | |
|---|---|---|---|
| 478,166 | 7/1892 | Madsen | 128/25 B |
| 1,358,640 | 11/1920 | Koyama | 272/144 X |
| 1,509,793 | 9/1924 | Thompson | 272/96 |
| 1,531,670 | 3/1925 | Levy | 272/96 |
| 1,535,391 | 4/1925 | Anderson | 272/132 |
| 2,035,549 | 3/1936 | Jones | 272/96 |
| 2,206,902 | 7/1940 | Kost | 172/96 |
| 2,256,763 | 9/1941 | Reed | 403/138 |
| 2,906,573 | 9/1959 | Runton | 403/144 |
| 3,134,591 | 5/1964 | Conn | 272/146 |
| 3,525,522 | 8/1970 | Piller | 172/96 |
| 3,782,721 | 1/1974 | Passera | 272/132 |
| 3,988,931 | 11/1976 | Perryman | 73/379 |

FOREIGN PATENT DOCUMENTS

| | | | |
|---|---|---|---|
| 227571 | 10/1910 | Fed. Rep. of Germany | 272/146 |
| 1372342 | 10/1974 | United Kingdom | 272/146 |

*Primary Examiner*—Richard J. Johnson

[57] ABSTRACT

An exerciser for use in the rehabilitation of the leg, ankle, and foot muscles has a foot support connected to a base of a ball and socket joint enabling the support to be tilted in any direction by a foot supported thereby. The joint includes a threaded member operable to provide selected resistance to such tilting and a pointer and scale are also provided to enable the resistance to be correlated to the size of the supported foot.

6 Claims, 4 Drawing Figures

46
41
45
43
3
39
24
44
42
37
27
19
21
34
18
35
17
13
3
12
10
11

46
10
46
45
44
37
40
42
18
39
41
47
48
49
50
51
52
42
40
36
44
43
46

EXERCISER FOR LOWER LEG, ANKLE, AND FOOT MUSCLES

BACKGROUND REFERENCES

U.S. Letters Pat. No. 1,509,793
U.S. Letters Pat. No. 2,035,549
U.S. Letters Pat. No. 2,206,902
U.S. Letters Pat. No. 3,525,522

BACKGROUND OF THE INVENTION

The musculature of the lower leg, ankle and foot is frequently found in a weakened or atrophied condition. This is usually due to immobilization because of an acute injury or some long term, chronic condition, both causes occurring at a high frequency rate in and out of athletics with ankle joint injuries the most common injuries that athletes suffer.

After an injury, the problem is that hemorrhage and inflammation lead to pain and spasms in the soft tissue surrounding the joint which force the individual into a period of disuse. Such disuse, in a few days can cause a decrease in muscle tissue size and strength. It is with various exercise techniques and resistance apparatus and the guidance of a physical therapist or athletic trainer that normal strength and functions are regained.

Once swelling and inflammation have been controlled, the patient should begin a progressive rehabilitation program within the limits of pain and under the direct orders of a physician with the objective or achieving a degree of range and strength equal to that of the uninvolved extremity by gradually restoring the full range of foot motion patterns with a gradual increase in the resistance to such movements by the patient. Only in this way can the individual return to normal acitivity, the possibility of reinjury lessened and the individual be medically cleared to participate in full acitivity.

There are twelve extrinsic muscles of the foot which originate in the lower leg and cross the ankle joint and it is these which give strength and power to the ankle and foot and prevent hypermobility and its associated injuries, i.e., sprain, subluxation, dislcoation and fracture. The muscle tendon units should act as finely tuned control arms to allow normal motion and prevent abnormal motion from occurring. It is imperative that injured muscular systems be restored to full strength with normal mobility.

The method used to gain strength and mobility is as important as the fact that such strength and mobility must be restored. The ankle and foot are capable of a variety of movement patterns because of a number of highly mobile bony articulations and their linkage with the muscular system and thus enable the performance of such activities as walking, running, jumping and lateral movements with the cutting from side-to-side in athletic events an example of maximum strain. To achieve a well balanced strength level, the injured muscles must be strengthened in patterns of motion used during full activity, i.e., diagonal, circular and straight patterns. If recovery leaves an imbalance in the muscular system, such may result in a loss of control and stability during activity when force is applied to bony or ligamentious structure causing reinjury.

Many times, in ankle rehabilitation, patients progress from motion exercise done without weight bearing to motion exercise done with weight bearing with running instituted as soon as pain and swelling has subsided. A pre-running program such as this is not demanding enough to allow the stress of running to involve the support of the body weight, a high level of coordination between agonistic and antagonistic muscles and a nearly full range of motion. Runninng should follow a very intense initial therapy as if begun too early, it may cause further trauma to the injured part, or a new condition to develop in a previously pain free area.

Manual resistance to a variety of ankle and foot movements by the patient can be generated by a therapist or trainer to achieve a gradual build up in strength of the weakened muscles but this requires a "one on one" situation. Enough time must be available for the patient's therapy presenting scheduling problems for the rehabilitationist. There is thus, a need for an ankle exerciser which will enable the weak and imbalanced ankle muscles to be conditioned for full use without risk of reinjury then occurring.

This need has been recognized as evidenced by U.S. Pat. Nos. 1,509,793, 2,206,902 and 3,525,522.

Of these, the U.S. Pat. to Thompson, No. 1,509,793 provides a construction that provided essentially for fore and aft tilting with a ball and socket connection with the foot support necessary to permit the wanted motion designed for a fixed vertical guide forcing a predetermined limited lateral tilting. A positively placed spring provided opposition only in the case of plantar flexing.

The U.S. Pat. to Kost No. 2,206,902 provided foot supports supported by ball and socket joints with a motorized drive moving the supports along fixed paths causing combined fore and aft lateral tilting of the patient's foot.

The U.S. Pat. to Pillar No. 3,525,522, while permitting tilting motion only in a fore and aft direction, provided adjustable frictional resistance to such tilting.

As far as we are aware, however, the only foot exerciser in use is one manufactured by Elgin Co. of Sandwich, Illinois, and sold under the trademark Elgin Ankle Exerciser and enables progressive resistance to be applied during rehabilitation. Motion is limited to either plantar flexion and dorsiflexion (up and down) or inversion-eversion (side-to-side) motion. Resistance is provided by a weight added to the appropriate one of four stations and after a certain amount of exercise, the weight is moved from one station to another. Exercise in circular or diagonal patterns cannot be carried out and these are necessary to ensure that the muscles of the lower limbs are adequately strengthened. In addition, full range of motion in either pattern is required as with the weight in use, gravity causes the foot support to tilt to the maximum extent.

THE PRESENT INVENTION

The general objective of the invention is to provide a foot exerciser enabling the patient to move the foot supported thereby in any and all patterns of motion that are desirable for strengthening the members of the lower leg, ankle and foot with a constant adjustable resistance applied to the tilting of the support throughout such movements.

In accordance with the invention, the objective is attained with an exerciser having a base, a foot support, a universal joint connecting the support to the base to permit the support to be tilted by the patient in any direction, and adjustable means operable to provide wanted constant resistance to such tilting throughout any and all patterns of motion necessary to restore the members to their full strength to permit the full range of movements.

Another objective of the invention is to enable the resistance to be varied within a substantial range, from substantially zero torque pounds so that it can be used as initial therapy where the range of motion is limited and the muscles weak up to a maximum torque for athletes or others of superior strength. In accordance with the invention, this objective is attained by providing that the existing torque value is indicated on a scale.

Yet another objective of the invention is to enable the exerciser to be used by patients whose foot sizes are within a substantial range with the torque scale useful for all sizes in providing the appropriate resistance. This objective is attained by providing that the torque scale is readable from a minimum value at which the foot support is held against movement by gravity and in relation to a particular foot size. Since the longer the foot, the greater its leverage, means are provided to enable the adjustable means to be set to provide an increase in resistance appropriate for any large sized foot to provide the same resistance as is indicated for use as represented for the foot in relation to which the scale is calibrated. The foot support is desirably marked in terms of foot sizes and to ensure accuracy, a chart is provided by which any selected resistance can be correlated with any foot size and any foot size correlated with any wanted resistance as represented by the scale.

Another important objective of the invention is to provide a smoothly functioning universal joint of the ball and socket type with adjustable frictional resistance, an objective attained with the joint including a holder attached to the undersurface of the support and formed with a neck on which is threaded a nut having a retaining plate freely accommodating the shank of the ball and supporting a ring dimensioned to accommodate the lower part of the ball. The holder slidably receives a ring dimensioned to fit the upper part of the ball and is backed by a compression spring. The holder has a pointer overlying a circular gauge the zero reading of which sets the spring tension such as to hold the foot support against moving in response to gravity.

Other objectives of the invention will be apparent from the specification and appended claims.

BRIEF DESCRIPTION OF THE DRAWINGS

In the accompanying drawings a preferred embodiment of the invention is illustrated with FIG. 1 a side elevation of the exerciser.

THE PREFERRED EMBODIMENT OF THE INVENTION

Figure 1:
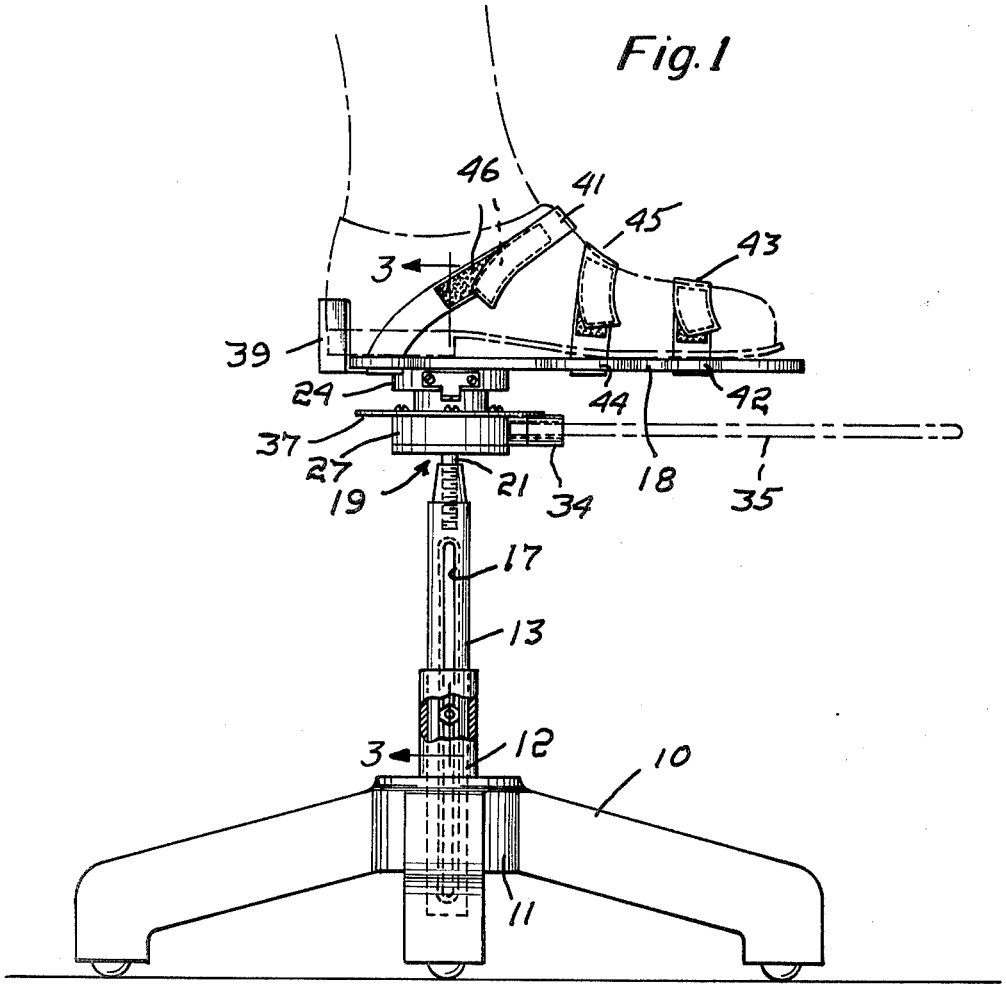
Figure 2:
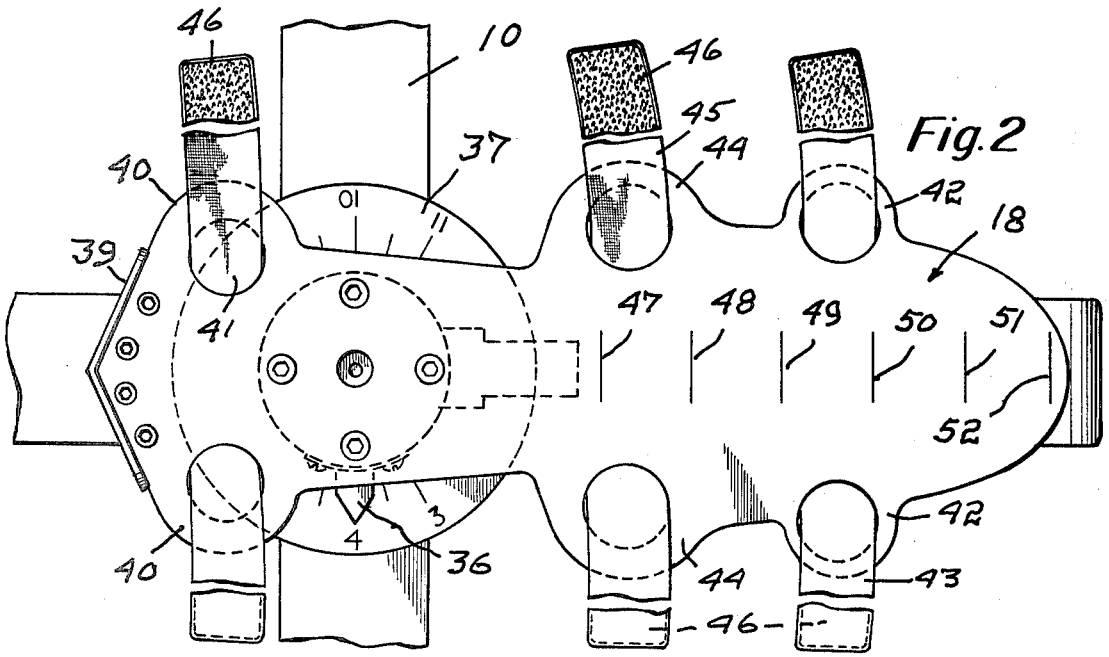
FIG. 2 is a top plan view thereof on an increase in scale.
Figure 3:
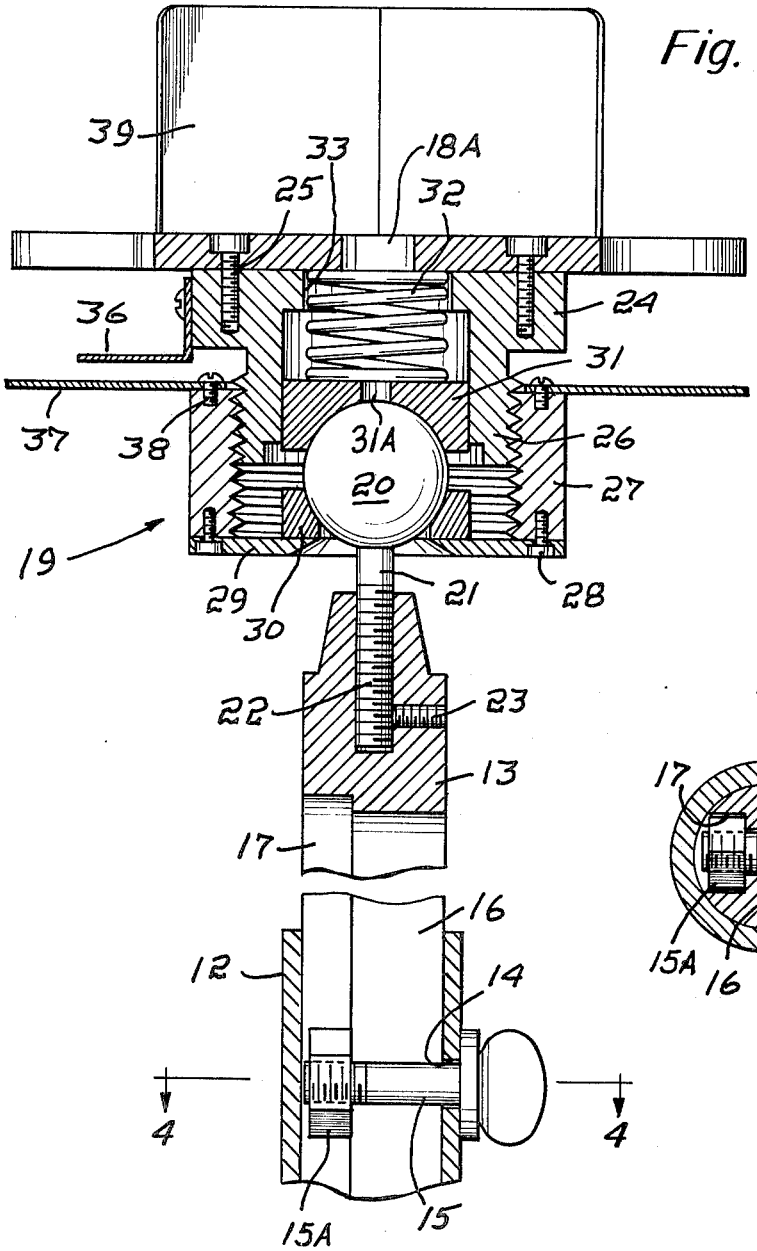
FIG. 3 is a section on a further increase in scale, taken substantially along the indicated line 3—3 of FIG. 1.
Figure 4:
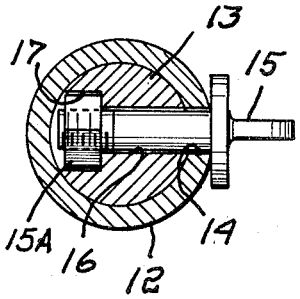
FIG. 4 is a section taken approximately along the indicated line 4—4 of FIG. 3.

In accordance with the invention, a base 10 has a hub 11 provided with a vertical socket 12 of a substantial length dimensioned to receive and slidably support a post 13 and provided with a hole 14 though which extends a winged bolt 15. A lengthwise, bolt-receiving slot 16 extends diametrically through the post 13 and opens into a lengthwise seat 17 dimensioned to slidably retain a nut 15A threaded on the bolt 15. The post 13 may thus be raised or lowered relative to the base 10 and locked in any selected position by so turning the winged bolt 15 as to draw the nut 15A into locking contact with its seat 17.

The exerciser includes a foot support 18 and is connected to the post 13 by a universal joint, generally indicated at 19 and enabling the patient to tilt his foot to follow any and all desired exercise patterns. The universal joint 19 includes a ball 20 provided with a shank 21 shown as threaded in an axial socket 22 in the upper end of the post 13 and locked therein by a set screw 23.

A holder 24 is secured to the undersurface of the foot support 18 by screws 25 and includes a neck 26 on which a nut 27 is threaded and to which is secured, by screws 28, a retaining ring 29 freely receiving the shank 21 and supporting an annular seat 30 for the lower part of the ball 20. The holder 24 slidably confines an annular seat 31 for the upper portion of the ball 20 and backed by a compression spring 32 confined in the counterbore 33 of the holder 25 and itself backed by the foot support 18. The foot support 18 and the seat 31 have holes 18A and 31A, respectively, enabling the ball 20 to be lubricated from time to time, ensuring the smooth functioning of the joint 19.

The nut 27 has a laterally projecting socket 34 enabling a bar 35 to be inserted therein and then used to turn the nut 27 in one direction or the other to vary the tension of the spring 32 on the upper ball seat 31 and thus vary the resistance to movement of the universal joint 19. It will be noted that the holder 24 has a pointer 36 readable with reference to a circular scale 37 secured to the upper surface of the nut 27 by screws 38 with its graduations representing torque in pounds with the "zero" marking, not shown, representing a spring setting in which the foot support 18 is held against movement by gravity.

The foot support 18 has a seat 39 against which backs the heel of the patient's foot or shoe, if one is worn, and a series of pairs of eyes spaced from each other lengthwise of the support, the rearward pair 40 retaining the strap 41 to be of length such that its ends may extend forwardly over the arch of the patient's foot and be then interconnected, a forward pair 42 retaining the strap 43 of length to extend over the toe of the foot and then interconnected and an intermediate pair 44 for the strap 45 of a length to be interconnected about the patient's foot and necessary if the foot is not long enough to be held by the strap 43. The straps are shown as having their ends provided with lengths 46 of material such as Velcron but they may be of other types and attached to the foot support and interconnected in different ways.

As it is essential to proper muscular rehabilitation that the exercising effort be against resistance that can be increased as the strength of the muscle increases, it is necessary to know the torque to be used. While the reading of the scale 37 by the pointer 36 is in terms of torque, that reading must be related to the size of the patient's foot for the longer the foot, the greater its leverage.

For that reason, the upper surface of the support 18 is provided with a series of graduations 47, 48, 49, 50, 51, and 52 and a chart is provided enabling the spring tension to be adjusted so that a predetermined torque value can be easily determined for any sized foot which value will require a different spring tension and a different relationship between the pointer 36 and its scale for each foot size as is illustrated by the following example.

The following is chart data to illustrate the condition of scale settings readable in terms of pounds in terms of foot sizes in terms of the distance from the axis of the universal joint 19 to the ball of the foot.

CALIBRATION CHART (IN POUNDS)

| TORQUE SETTING | DISTANCE TO BALL OF FOOT | | | | | | |
|---|---|---|---|---|---|---|---|
| | A | B | C | D | E | F | G |
| −1 | 2.0 | 1.5 | 1.0 | .5 | 0 | 0 | 0 |
| 0 | 3.0 | 2.5 | 2.0 | 1.5 | 1.0 | .5 | 0 |
| 1 | 4.0 | 3.5 | 3.0 | 2.5 | 2.0 | 1.5 | 1.0 |
| 2 | 5.0 | 4.5 | 4.0 | 3.5 | 3.0 | 2.5 | 2.0 |
| 3 | 6.0 | 5.0 | 4.5 | 4.0 | 3.5 | 3.0 | 2.5 |
| 4 | 6.5 | 5.5 | 5.0 | 4.5 | 3.5 | 3.5 | 3.0 |
| 5 | 7.0 | 6.5 | 5.5 | 5.0 | 4.0 | 4.0 | 3.5 |
| 6 | 8.5 | 7.0 | 6.0 | 5.5 | 4.5 | 4.5 | 4.0 |
| 7 | 10.0 | 8.0 | 7.0 | 6.0 | 5.0 | 5.0 | 4.5 |
| 8 | 14.5 | 10.5 | 8.0 | 7.0 | 6.0 | 5.5 | 5.0 |
| 9 | 17.5 | 12.5 | 10.0 | 8.5 | 8.0 | 7.5 | 6.0 |
| 10 | 22.0 | 17.5 | 13.5 | 11.0 | 10.0 | 10.0 | 9.0 |
| 11 | 27.0 | 25.0 | 17.0 | 16.0 | 14.5 | 13.0 | 12.0 |
| 12 | 30 | 30 | 23 | 20 | 18 | 17 | 16 |
| 13 | 37 | 32 | 27 | 25 | 23 | 21 | 20 |
| 14 | 40 | 35 | 32 | 30 | 28 | 25 | 22 |
| 15 | 44 | 40 | 36 | 34 | 32 | 30 | 26 |
| 16 | 50 | 45 | 40 | 37 | 35 | 32 | 30 |
| +1 | | 50 | 45 | 40 | 38 | 36 | 34 |
| +2 | | | 50 | 45 | 42 | 40 | 37 |
| +3 | | | | 50 | 48 | 45 | 42 |
| +4 | | | | | 55 | 50 | 46 |

From the foregoing, it will be apparent that an exerciser in accordance with the invention enables the height of the foot support 18 to be adjusted for use by the patient when seated. When the foot of the patient, or the shoe, if one is worn, is strapped to the support 18, the support 18 will not tilt by itself but may be tilted to provide any and all motion patterns that are normal with the resistance to such motions adjustable as the strength of the muscles increases.

We claim:

1. An exerciser for use in rehabilitation of lower leg, ankle, and foot muscles, said exerciser including a base, a support for a foot, a connection between the base and the central part of the heel area of the support to be tilted in any direction by a foot held by said support and said connection including adjustable means operable to provide a wanted uniform resistance to such tilting of said support, said adjustable means including first and second relatively movable parts, one part including an arcuate scale parallel to the support with a portion exposed laterally thereof of graduations which are calibrated in terms of pounds of torque required to overcome the existing resistance and the other part counter-traversing said scale as the resistance is varied, the first graduation represents a prevailing resistance that holds the foot support against tilting in response to gravity.

2. The exerciser of claim 1 in which the foot support is of sufficient length to accommodate feet of a substantial range of sizes and includes a seat against which the heel of each foot is held during exercising, and the scale is appropriate for a foot of one size due to the fact that the longer the foot, the greater the mechanical advantage thereby requiring such further relative movement between the parts that will provide the same resistance for the longer foot as was afforded by the pointer-to-scale reading for said one size and selected as the wanted resistance in the exercising of the longer foot.

3. The exerciser of claim 2 in which the foot support has a lengthwise series of graduations indicative of foot sizes.

4. The exerciser of claim 3 and a chart providing data relating the effective torque for each size for each graduation of said scale.

5. The exerciser of claim 1 in which the connection includes a ball and a socket therefor, said ball including a shank connected to said base, said socket including a first part secured to said support and having a downwardly opening chamber, a second ball-retaining part threaded on said first part, and a spring within said first part and operable to apply torsional resistance to the ball that is variable by turning the second part relative to the first part in one direction or the other, said second part including said scale and said first part said pointer.

6. The exerciser of claim 5 in which the first part includes a cylindrical chamber and the first part includes a retaining plate through which the shank freely extends, a first annular seat on said plate fits and supports the lower portion of the ball, a second annular seat fits the upper portion of the ball and is slidable in said chamber, and the spring is within said chamber and resiliently backs the second seat.

* * * * *